US010480714B2

(12) United States Patent
Sugiura et al.

(10) Patent No.: US 10,480,714 B2
(45) Date of Patent: Nov. 19, 2019

(54) LOW TEMPERATURE LIQUID TANK

(71) Applicant: IHI Corporation, Tokyo (JP)

(72) Inventors: Shinya Sugiura, Tokyo (JP); Masaki Takahashi, Tokyo (JP); Tomohiko Nakamura, Tokyo (JP)

(73) Assignee: IHI CORPORATION, Tokyo (JP)

( * ) Notice: Subject to any disclaimer, the term of this patent is extended or adjusted under 35 U.S.C. 154(b) by 946 days.

(21) Appl. No.: 14/850,424

(22) Filed: Sep. 10, 2015

(65) Prior Publication Data

US 2015/0377415 A1 Dec. 31, 2015

Related U.S. Application Data

(63) Continuation of application No. PCT/JP2013/082743, filed on Dec. 5, 2013.

(30) Foreign Application Priority Data

Mar. 29, 2013 (JP) ..... 2013-071115

(51) Int. Cl.
*F17C 3/04* (2006.01)
*F17C 3/02* (2006.01)

(52) U.S. Cl.
CPC ..... *F17C 3/04* (2013.01); *F17C 3/022* (2013.01); *F17C 2201/0109* (2013.01);
(Continued)

(58) Field of Classification Search
CPC ..... F17C 2223/0153; F17C 2223/0161; F17C 2260/011; F17C 3/04; F17C 3/06; F17C 2270/0136; F17C 2270/0139
(Continued)

(56) References Cited

U.S. PATENT DOCUMENTS 3,397,443 A 8/1968 Johansson
3,860,140 A * 1/1975 Wichman ..... F17C 3/022 220/560.04
(Continued)

FOREIGN PATENT DOCUMENTS

CN 1666060 A 9/2005
CN 102027282 A 4/2011
(Continued)

OTHER PUBLICATIONS

International Search Report dated Mar. 18, 2014 in PCT/JP2013/082743 (4 pages).
U.S. Appl. No. 15/007,453, Takuya Nakano, filed Jan. 27, 2016.

*Primary Examiner* — Anthony D Stashick
*Assistant Examiner* — Raven Collins
(74) *Attorney, Agent, or Firm* — Rothwell, Figg, Ernst & Manbeck, P.C.

(57) ABSTRACT

A low temperature liquid tank includes: a storage tank having a bottom portion obtained by joining a plurality of bottom plates; and a support portion supporting the bottom portion. The support portion includes: an outer support portion supporting a margin of the storage tank; and an inner support portion disposed inside the outer support portion and having a heat insulation in which creep occurs when a load is applied. An initial height of an upper surface of the inner support portion is set so that, during a service life of the low temperature liquid tank, maximum bending stress applied to the bottom plates due to a difference between a height of the upper surface of the inner support portion and a height of an upper surface of the outer support portion remains equal to or smaller than an allowable bending stress of the bottom plates.

10 Claims, 3 Drawing Sheets

(52) U.S. Cl.
CPC . *F17C 2201/0119* (2013.01); *F17C 2201/032* (2013.01); *F17C 2201/052* (2013.01); *F17C 2203/0329* (2013.01); *F17C 2203/0629* (2013.01); *F17C 2203/0639* (2013.01); *F17C 2203/0646* (2013.01); *F17C 2221/033* (2013.01); *F17C 2221/035* (2013.01); *F17C 2223/0153* (2013.01); *F17C 2223/0161* (2013.01); *F17C 2223/033* (2013.01); *F17C 2260/011* (2013.01); *F17C 2270/0136* (2013.01)

(58) Field of Classification Search
USPC ..... 220/592.25
See application file for complete search history.

(56) References Cited

U.S. PATENT DOCUMENTS

| | | | |
|---|---|---|---|
| 3,927,497 | A | 12/1975 | Yoshinaga et al. |
| 6,316,513 | B1 | 11/2001 | McCullough et al. |
| 8,020,721 | B2 | 9/2011 | Skovholt et al. |
| 8,783,501 | B2 | 7/2014 | Mookerjee |
| 9,017,565 | B2 | 4/2015 | Joh et al. |
| 2005/0144864 | A1 | 7/2005 | Skovholt et al. |
| 2011/0056955 | A1* | 3/2011 | Joh ..... B63B 25/16 220/560.12 |
| 2012/0305524 | A1 | 12/2012 | Joh et al. |
| 2012/0325821 | A1 | 12/2012 | Mookerjee |
| 2014/0331690 | A1* | 11/2014 | Han ..... F17C 3/027 62/45.1 |
| 2015/0377550 | A1 | 12/2015 | Sakai |

FOREIGN PATENT DOCUMENTS

| | | | |
|---|---|---|---|
| CN | 102792084 | A | 11/2012 |
| EP | 2 530 368 | A1 | 12/2012 |
| JP | 49-71396 | | 7/1974 |
| JP | 60-67499 | U | 5/1985 |
| JP | 2000-94466 | A | 4/2000 |
| JP | 2000-171148 | A | 6/2000 |
| JP | 2000-511957 | A | 9/2000 |
| JP | 2000-346294 | A | 12/2000 |
| JP | 2004-285319 | A | 10/2004 |
| JP | 2004-285321 | A | 10/2004 |
| JP | 2007-2118 | A | 1/2007 |
| JP | 2008-164066 | A | 7/2008 |
| JP | 2009-202889 | A | 9/2009 |
| TW | 201144189 | A1 | 12/2011 |

* cited by examiner

LOW TEMPERATURE LIQUID TANK

CROSS REFERENCE TO RELATED APPLICATIONS

This application is a continuation application based on a PCT Patent Application No. PCT/JP2013/082743, filed Dec. 5, 2013, whose priority is claimed on Japanese Patent Application No. 2013-071115, filed on Mar. 29, 2013. The contents of both the PCT Application and the Japanese Application are incorporated herein by reference.

TECHNICAL FIELD

Embodiments described herein relate to a low temperature liquid tank.

BACKGROUND ART

Tanks (low temperature liquid tanks) in which a low temperature liquid is stored, such as liquefied natural gas (LNG) tanks or liquefied petroleum gas (LPG) tanks, are each equipped with a storage tank in which the low temperature liquid is stored and a support portion that supports the storage tank. To prevent heat from being input from the ground, a heat insulation is included in the support portion (bottom cold insulating structure).

Conventionally, foam glass, which has high rigidity and in which the effect of creep caused by a load applied from above is negligible in a manner similar to concrete, has been used as the heat insulation included in the support portion. Further, in recent years, a technique in which a margin including a sidewall of a storage tank is formed of a material in which the effect of creep is negligible, such as concrete, and a water- or cyclopentane-foamed heat insulation having higher cold insulating performance as shown in Patent Documents 1 and 2 is arranged inside the margin has also been proposed.

CITATION LIST

Patent Documents

Patent Document 1: Japanese Unexamined Patent Application, First Publication No. 2007-2118

Patent Document 2: Japanese Unexamined Patent Application, First Publication No. 2000-171148

SUMMARY

Technical Problem

However, unlike foam glass, a water- or cyclopentane-foamed heat insulation does not have high rigidity. For this reason, there is a possibility of creep occurring during the service life of a low temperature liquid tank and of an upper surface of the support portion that supports the storage tank gradually sinking.

If the upper surface of the middle portion of the support portion including the water- or cyclopentane-foamed heat insulation sinks in this way, a great level difference occurs between the upper surface of the middle portion and the upper surface of portions supporting the margin of the storage tank. Due to the level difference, the bottom portion of the storage tank is bent. Thus, bending stress occurs, and a great load is applied to the bottom portion of the storage tank. For this reason, during the use of the low temperature liquid tank, a possibility of a need to perform large-scale maintenance on the bottom portion of the storage tank arising is increased.

In the tanks in which low-temperature liquids are stored at a low temperature with no change in temperature, including but not limited to LNG tanks and LPG tanks, the heat insulation is included in the support portion that supports the storage tank. Thus, when the water- or cyclopentane-foamed heat insulation is used as the heat insulation, the same problems occur.

The present disclosure has been made in consideration of the aforementioned problems, and an object of the present disclosure is to provide a low temperature liquid tank that inhibits a great load from being applied to a bottom portion thereof while in use.

Solution to Problem

The present disclosure employs the following structures as means of solving the above-described problems.

A first aspect of the present disclosure provides a low temperature liquid tank that includes: a storage tank having a bottom portion obtained by joining a plurality of bottom plates; and a support portion supporting the bottom portion, in which the support portion includes: an outer support portion supporting a margin of the storage tank including a sidewall of the storage tank; and an inner support portion disposed inside the outer support portion and having a heat insulation in which creep occurs when a load is applied to the heat insulation, and an initial height of an upper surface of the inner support portion is set so that, during a service life of the low temperature liquid tank, maximum bending stress applied to the bottom plates due to a difference between a height of the upper surface of the inner support portion and a height of an upper surface of the outer support portion remains equal to or smaller than an allowable bending stress of the bottom plates.

A second aspect of the present disclosure is configured such that, in the first aspect, the initial height of the upper surface of the inner support portion is set to be higher than that of the upper surface of the outer support portion.

A third aspect of the present disclosure is configured such that, in the first or second aspect, the inner support portion has a height setting plate that prescribes the initial height of the upper surface of the inner support portion.

A fourth aspect of the present disclosure is configured such that, in the third aspect, the height setting plate is a heat-resistant board disposed on the heat insulation.

A fifth aspect of the present disclosure is configured such that, in any one of the first to fourth aspects, an edge of the outer support portion which is adjacent to the inner support portion is chamfered.

A sixth aspect of the present disclosure is configured such that, in any one of the first to fifth aspects, the heat insulation is a rigid plastic foam.

Advantageous Effects

In the present disclosure, the initial height of the upper surface of the inner support portion is set such that the maximum bending stress applied to the bottom plates due to the difference between the height of the upper surface of the inner support portion and the height of the upper surface of the outer support portion during a service life of the low temperature liquid tank does not exceed the allowable bending stress of the bottom plates. For this reason, according to the present disclosure, the difference between the height of the upper surface of the inner support portion and the height of the upper surface of the outer support portion is not great enough to have an influence on the bottom plates during the service life of the low temperature liquid tank. Accordingly, according to the present disclosure, the low temperature liquid tank can inhibit a great load from being applied to the bottom while in use.

DESCRIPTION OF EMBODIMENTS

Figure 1:
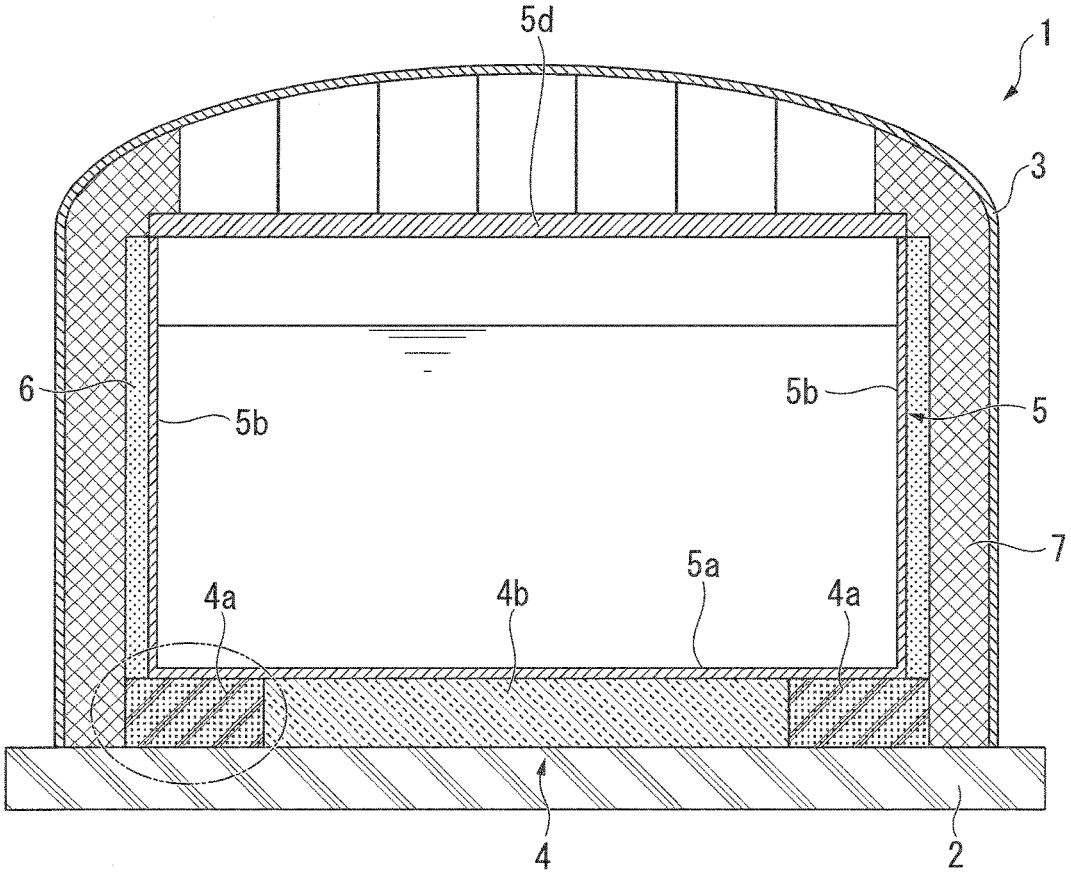
FIG. 1 is a sectional view schematically showing a general constitution of an LNG tank in an embodiment of the present disclosure.

Hereinafter, an embodiment of a low temperature liquid tank according to the present disclosure will be described with reference to the drawings.

Note that in the drawings, a scale of each member is adequately changed such that each member has a recognizable size. Further, in the present embodiment, as the low temperature liquid tank, a liquefied natural gas (LNG) tank will be described by way of example.

FIG. 1 is a sectional view schematically showing a general constitution of an LNG tank 1 of the present embodiment. As shown in FIG. 1, the LNG tank 1 of the present embodiment is a ground-type metal double shell tank, and is equipped with a base plate 2, an outer tank 3, a bottom cold insulating mechanism (support portion) 4, an inner tank (storage tank) 5, a blanket 6, and a lateral cold insulation 7.

The base plate 2 is a disc-like member formed of concrete, and supports the outer tank 3, the bottom cold insulating mechanism 4, the inner tank 5, the blanket 6, and the lateral cold insulation 7. The outer tank 3 is a cylindrical container formed of carbon steel, and is erected on the base plate 2 so as to surround the bottom cold insulating mechanism 4, the inner tank 5, the blanket 6, and the lateral cold insulation 7. The bottom cold insulating mechanism 4 is disposed under the inner tank 5 inside the outer tank 3, and is adapted to support the inner tank 5. The bottom cold insulating mechanism 4 is a member equivalent to the support portion in the present disclosure, and details thereof will be described below.

The inner tank 5 is a cylindrical container in which LNG is stored, and is erected on the bottom cold insulating mechanism 4. The inner tank 5 is made up of a bottom portion 5*a* and a sidewall 5*b* formed of nickel steel, an annular plate 5*c* connecting the bottom portion 5*a* and the sidewall 5*b* (see FIGS. 2A and 2B), and a ceiling 5*d* that is formed of aluminum steel and is supported in a suspended state. The bottom portion 5*a* of the inner tank 5 is formed in such a manner that a plurality of bottom plates 5*a*1 (see FIGS. 2A and 2B) formed of nickel steel are joined. The annular plate 5*c* is a part of the inner tank 5 as described above. However, in the present embodiment, the annular plate 5*c* serves as a part of the support portion of the present disclosure. The blanket 6 is disposed to cover the sidewall 5*b* of the inner tank 5 from the outside, has a cold insulating function, and absorbs thermal deformation of the inner tank 5. The lateral cold insulation 7 is filled between the blanket 6 and the outer tank 3, and is formed of, for example, perlite.

Figure 2A:
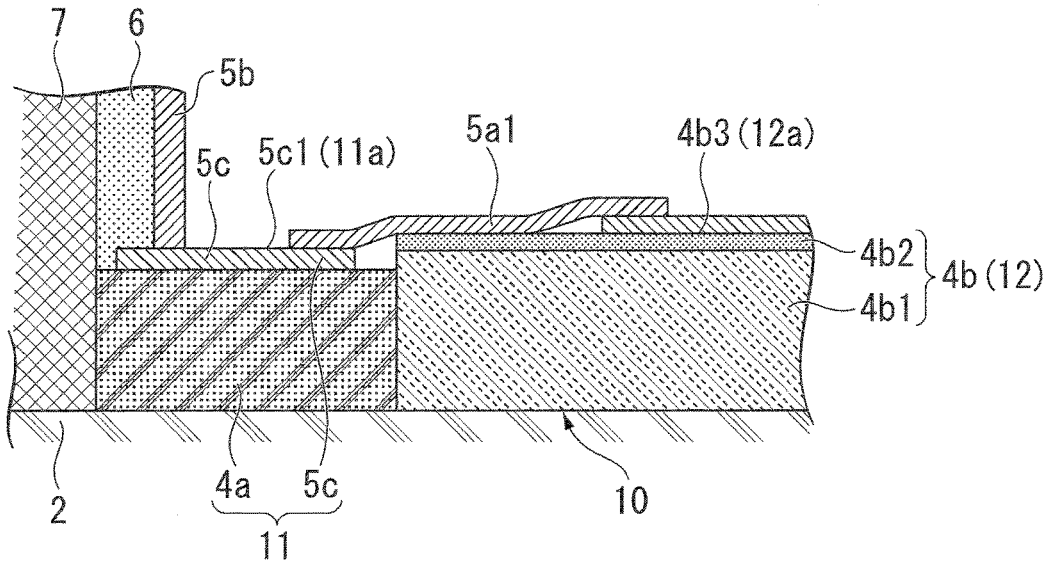
FIG. 2A is an enlarged view of an area A of FIG. 1.
Figure 2B:
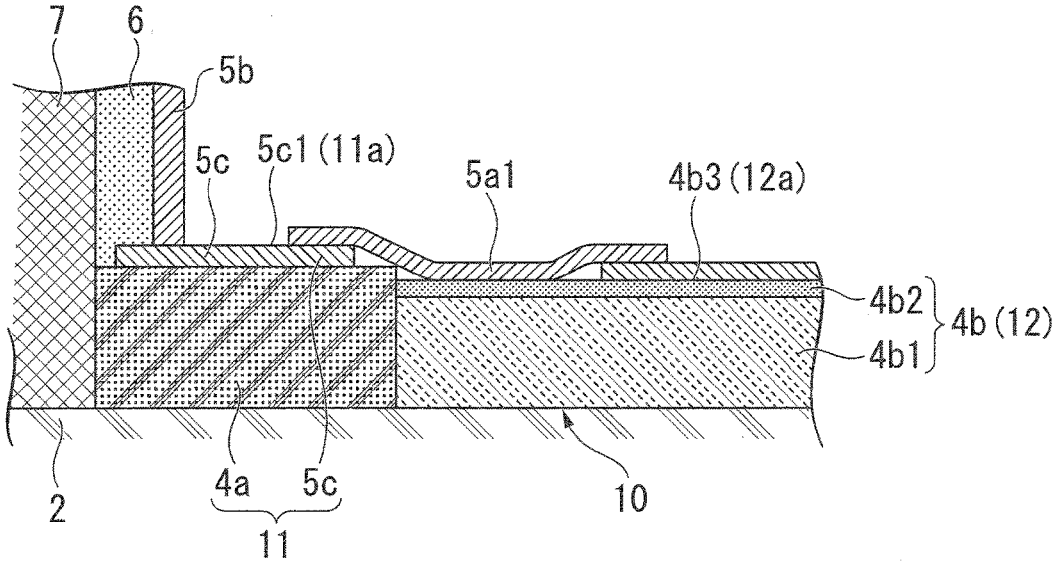
FIG. 2B is an enlarged view of the area shown in FIG. 2A after a service life has lapsed.

FIGS. 2A and 2B are enlarged views of an area A of FIG. 1. Note that it is shown in FIGS. 2A and 2B that each member is changed particularly in height among actual dimensions in order to emphasize a difference in the height of each member. As shown in FIGS. 2A and 2B, the bottom cold insulating mechanism 4 is made up of a peripheral section 4*a* disposed under the sidewall 5*b* of the inner tank 5, and a midsection 4*b* disposed inside the peripheral section 4*a*.

The peripheral section 4*a* supports the annular plate 5*c* of the inner tank 5, is formed of concrete, and is provided along the sidewall 5*b* of the inner tank 5 in an annular shape. The midsection 4*b* is formed by a heat insulating layer 4*b*1 installed on the base plate 2, and a plurality of calcium silicate boards 4*b*2 provided on the heat insulating layer 4*b*1.

The heat insulating layer 4*b*1 is a member for preventing heat from being input to the inner tank 5 from the ground. In the present embodiment, the heat insulating layer 4*b*1 is formed of a rigid plastic foam, in which, unlike concrete or foam glass, creep occurs due to a load from above. To be more specific, the heat insulating layer 4*b*1 may be formed of a rigid urethane foam, a rigid polyisocyanurate foam, or a rigid polyvinyl chloride foam.

The calcium silicate boards 4*b*2 are heat-resistant boards, and upper surfaces 4*b*3 thereof serve as supporting surfaces which support the bottom plates 5*a*1 that form the bottom portion 5*a* of the inner tank 5. These calcium silicate boards 4*b*2 prevent a heat effect on the underlaid heat insulating layer 4*b*1 when the bottom plates 5*a*1 are welded to each other while the LNG tank 1 is under construction.

As shown in FIG. 2A, the bottom portion 5*a* (i.e., the bottom plates 5*a*1) of the inner tank 5 is in contact with an upper surface 5*c*1 of the annular plate 5*c* at a margin of the inner tank 5, and is in contact with the upper surfaces 4*b*3 of the calcium silicate boards 4*b*2 at the midsection of the inner tank 5. That is, the bottom portion 5*a* of the inner tank 5 is supported by the bottom cold insulating mechanism 4 and the annular plate 5*c*. In the LNG tank 1 of the present embodiment, a structure made up of the bottom cold insulating mechanism 4 and the annular plate 5*c* is referred to as a support portion 10. Further, a peripheral section of the support portion 10 is made up of the peripheral section 4*a* of the bottom cold insulating mechanism 4 and the annular plate 5*c*, and supports the margin of the inner tank 5 including the sidewall 5*b* of the inner tank 5. Hereinafter, the peripheral section of the support portion 10 is referred to as an outer support portion 11. In addition, a midsection of the support portion 10 is made up of the midsection 4*b* of the bottom cold insulating mechanism 4. Hereinafter, the midsection of the support portion 10 is referred to as an inner support portion 12. That is, the LNG tank 1 of the present embodiment includes the outer support portion 11 that supports the margin of the inner tank 5 including the sidewall 5*b* of the inner tank 5, and the inner support portion 12 that is disposed inside the outer support portion 11 and that has the heat insulating layer 4*b*1 formed of the heat insulation in which creep occurs when a load is applied.

FIG. 2A shows a state immediately after construction of the LNG tank 1 of the present embodiment is completed. As shown in FIG. 2A, in the LNG tank 1 of the present embodiment, an upper surface 12*a* (i.e., the calcium silicate boards 4*b*2) of the inner support portion 12 has an initial height set to be higher than a height of an upper surface 11*a* (the upper surface 5*c*1 of the annular plate 5*c*) of the outer support portion 11. In the LNG tank 1 of the present embodiment, since the heat insulating layer 4*b*1 formed of rigid plastic foam is included in the bottom cold insulating mechanism 4, when the heat insulating layer 4*b*1 receives a load from above due to weight of LNG stored in the inner tank 5, creep occurs in the heat insulating layer 4*b*1. For this reason, in the LNG tank 1 of the present embodiment, the heat insulating layer 4*b*1 is gradually compressed due to long-term use, and the upper surface 12*a* of the inner support portion 12 sinks. As a result, after the service life of the LNG tank 1 has lapsed, the upper surface 12*a* of the inner support portion 12 is, as shown in FIG. 2B, located below the upper surface 11*a* of the outer support portion 11.

Here, in the LNG tank 1 of the present embodiment, an extent value to which the upper surface 12*a* of the inner support portion 12 sinks after the service life of the LNG tank 1 has lapsed is obtained through experimentation or simulation in a design step, and the initial height of the upper surface 12*a* of the inner support portion 12 is set based on the obtained value so as not to affect a great effect on the bottom plates 5*a*1. To be specific, a difference between the height of the upper surface 12*a* of the inner support portion 12 and the height of the upper surface 11*a* of the outer support portion 11 is obtained from an amount of sinkage of the upper surface 12*a* of the inner support portion 12. Maximum bending stress applied to the bottom plates 5*a*1 is obtained from this difference, and is compared with allowable bending stress of the bottom plates 5*a*1 (stress at which the bottom plates 5*a*1 can be estimated not to need repair during the service life of the LNG tank 1). The initial height of the upper surface 12*a* is set such that the maximum bending stress does not exceed the allowable bending stress of the bottom plates 5*a*1. The initial height is naturally set such that the maximum bending stress applied to the bottom plates 5*a*1 by the difference between the height of the upper surface 12*a* of the inner support portion 12 and the height of the upper surface 11*a* of the outer support portion 11 at an initial stage does not exceed the allowable bending stress of the bottom plates 5*a*1.

As described above, in the LNG tank 1 of the present embodiment, the initial height of the upper surface 12*a* of the inner support portion 12 is set such that the maximum bending stress applied to the bottom plates 5*a*1 due to the difference between the height of the upper surface 12*a* of the inner support portion 12 and the height of the upper surface 11*a* of the outer support portion 11 during the service life of the LNG tank 1 remains equal to or smaller than the allowable bending stress of the bottom plates 5*a*1. For this reason, according to the LNG tank 1 of the present embodiment, the difference between the height of the upper surface 12*a* of the inner support portion 12 and the height of the upper surface 11*a* of the outer support portion 11 does not become great enough to have an influence on the bottom plates 5*a*1 during the service life of the LNG tank 1. Accordingly, according to the LNG tank 1 of the present embodiment, it is possible to inhibit a great load from being applied to the bottom portion 5*a* of the inner tank 5 during the use of the LNG tank 1.

Further, the initial height of the upper surface 12*a* of the inner support portion 12 may be adjusted, for instance, by changing thicknesses of the components (i.e., in the present embodiment, the heat insulating layer 4*b*1 and the calcium silicate boards 4*b*2) of the inner support portion 12 or by raising the base plate 2. Also, the height of the upper surface 12*a* of the inner support portion 12 may be adjusted by newly installing on the inner support portion 12*a* height setting plate for prescribing the height of the upper surface 12*a*. However, since it is easy to adjust the thicknesses of the calcium silicate boards 4*b*2, the calcium silicate boards 4*b*2 are preferably used as the height setting plate.

While a preferred embodiment of the present disclosure has been described with reference to the attached drawings, it goes without saying that the present disclosure is not limited to the above embodiment. All the shapes and combinations of the components shown in the aforementioned embodiment are only examples and can be variously modified based on design requirements without departing from the spirit and scope of the present disclosure.

Figure 3A:
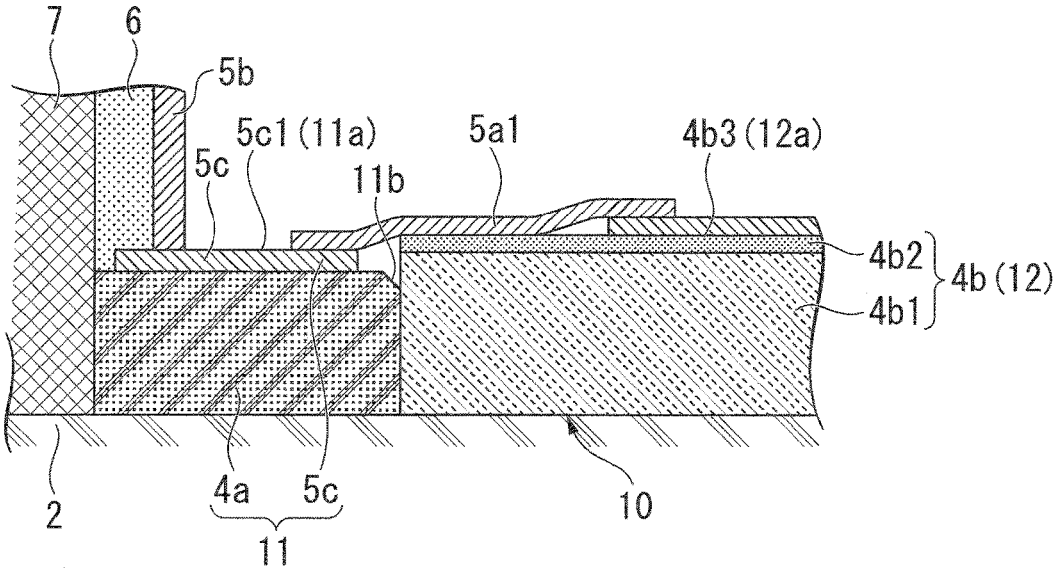
FIG. 3A is an enlarged view in a modification of the LNG tank.
Figure 3B:
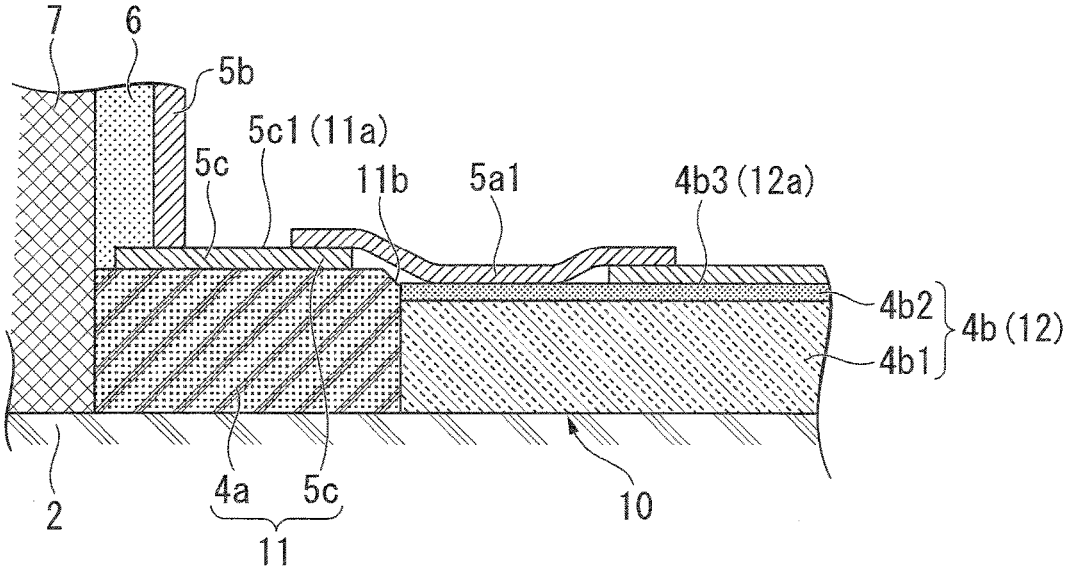
FIG. 3B is an enlarged view of the area shown in FIG. 3A after a service life has lapsed.

For example, as shown in FIG. 3A, a constitution in which an edge 11*b* of the outer support portion 11 which is adjacent to the inner support portion 12 is chamfered may also be employed. As a result of employing this constitution, as shown in FIG. 3B, even when the upper surface 12*a* of the inner support portion 12 sinks and is located below the upper surface 11*a* of the outer support portion 11, the edge of the outer support portion 11 can be prevented from colliding with the bottom plates 5*a*1 and high stress can be prevented from being locally applied to the bottom plates 5*a*1.

Also, in the above embodiment, the constitution in which the outer support portion 11 is made up of the peripheral section 4*a* of the bottom cold insulating mechanism 4 and the annular plate 5*c*, the bottom plates 5*a*1 are supported by the upper surface of the annular plate 5*c*, and the annular plate 5*c* and each bottom plate 5*a*1 overlap and are welded together is employed. However, the present disclosure is not limited to this constitution. For example, a constitution in which the bottom plates 5*a*1 are directly supported by the upper surface of the peripheral section 4*a* of the bottom cold insulating mechanism 4 and each bottom plate 5*a*1 and the annular plate 5*c* are butted and welded may also be employed.

In this case, the bottom plates 5*a*1 are supported by the upper surface of the peripheral section 4*a* of the bottom cold insulating mechanism 4. For this reason, the outer support portion is configured of only the peripheral section 4*a* of the bottom cold insulating mechanism 4, and the upper surface of the peripheral section 4*a* becomes the upper surface of the outer support portion.

Also, in the above embodiment, the constitution in which the inner support portion 12 is made up of the heat insulating layer 4*b*1 formed of the rigid urethane foam and the calcium silicate boards 4*b*2 is employed. However, the present disclosure is not limited to this constitution, and the inner support portion 12 may also have a different structure. For example, a constitution in which a second heat insulating layer formed of, for example, foam glass is included in the inner support portion 12 may be employed. Also, foam glass may be disposed at an upper layer, and the calcium silicate boards 4*b*2 may be removed. When the structure of the inner support portion 12 is changed, the component having a surface supporting the bottom plates 5*a*1 is also modified.

Also, in the above embodiment, the constitution in which the heat insulating layer 4*b*1 is formed of the rigid urethane foam has been described. However, the heat insulating layer is not limited to the rigid urethane foam, and any foamed plastic may be used as the heat insulating layer.

Also, in the above embodiment, the example in which the low temperature liquid tank of the present disclosure is applied to the LNG tank 1 has been described. However, the low temperature liquid tank of the present disclosure may also be applied to an LPG tank or other low temperature liquid tanks.

In addition, in the present disclosure, the initial height of the upper surface of the inner support portion is not necessarily higher than that of the upper surface of the outer support portion. For example, the initial height of the upper surface of the inner support portion may be flush with that of the upper surface of the outer support portion.

INDUSTRIAL APPLICABILITY

The low temperature liquid tank can inhibit a great load from being applied to the bottom portion while in use.

REFERENCE SIGNS LIST

1: LNG tank (low temperature liquid tank)
2: base plate
3: outer tank
4: bottom cold insulating mechanism
4*a*: peripheral section
4*b*: midsection
4*b*1: heat insulating layer (heat insulation)
4*b*2: calcium silicate board (height setting plate)
4*b*3: upper surface
5: inner tank (storage tank)
5*a*: bottom portion
5*a*1: bottom plate
5*b*: sidewall
5*c*: annular plate
5*c*1: upper surface
5*d*: ceiling
6: blanket
7: lateral cold insulation
10: support portion
11: outer support portion
11*a*: upper surface
11*b*: edge
12: inner support portion
12*a*: upper surface

The invention claimed is:

1. A low temperature liquid tank comprising:

a storage tank having a bottom portion obtained by joining a plurality of bottom plates; and a support portion supporting the bottom portion, wherein the support portion includes:

an outer support portion supporting a margin of the storage tank including a sidewall of the storage tank; and an inner support portion disposed inside the outer support portion and having a heat insulation in which creep occurs when a load is applied to the heat insulation, an initial height of an upper surface of the inner support portion is set so that, during a service life of the low temperature liquid tank, maximum bending stress applied to the bottom plates due to a difference between a height of the upper surface of the inner support portion and a height of an upper surface of the outer support portion remains equal to or smaller than an allowable bending stress of the bottom plates, wherein the initial height of the upper surface of the inner support portion is set to be higher than that of the upper surface of the outer support portion, and wherein due to the creep when a load is applied, the upper surface of the inner support portion is lowered during the service life of the low temperature liquid tank, and wherein the initial height of the upper surface of the inner support portion is set so that the maximum bending stress applied to the bottom plates remains equal to or smaller than the allowable bending stress over the service life as the upper surface of the inner support portion is lowered.

2. The low temperature liquid tank according to claim 1, wherein the inner support portion has a height setting plate that prescribes the initial height of the upper surface of the inner support portion.

3. The low temperature liquid tank according to claim 2, wherein the height setting plate is a heat-resistant board disposed on the heat insulation.

4. The low temperature liquid tank according to claim 1, wherein an edge of the outer support portion which is adjacent to the inner support portion is chamfered.

5. The low temperature liquid tank according to claim 1, wherein the heat insulation is a rigid plastic foam.

6. The low temperature liquid tank according to claim 4, wherein the heat insulation is a rigid plastic foam.

7. The low temperature liquid tank according to claim 1, wherein the outer support portion is a peripheral section of the support portion, and the inner support portion is a midsection of the support portion; and the outer support portion and the inner support portion are provided on a base plate.

8. The low temperature liquid tank according to claim 1, wherein the bottom plates include at least one plate extending between the inner support portion and the outer support portion, and wherein the initial height is set so that the bending stress applied to the at least one plate remains equal to or smaller than the maximum allowable bending stress over the service life as the upper surface of the inner portion is lowered.

9. The low temperature liquid tank of claim 8, wherein during the service life, the height of the upper surface of the inner support portion becomes lower than that of the upper surface of the outer support portion.

10. The low temperature liquid tank of claim 1, wherein during the service life, the height of the upper surface of the inner support portion becomes lower than that of the upper surface of the outer support portion.

* * * * *